US005970772A

United States Patent [19]

Yoshizawa et al.

[11] Patent Number: 5,970,772

[45] Date of Patent: Oct. 26, 1999

[54] POSITIONING CONTROL DEVICE FOR GUIDE APPARATUS

[75] Inventors: Sadao Yoshizawa; Hideo Kunioku, both of Hokkaido, Japan

[73] Assignee: Kotobuki Sangyo Kabushiki Kaisha, Sapporo, Japan

[21] Appl. No.: 09/259,676

[22] Filed: Mar. 1, 1999

[51] Int. Cl.[6] ..... B21B 39/20

[52] U.S. Cl. ..... 72/250; 72/420

[58] Field of Search ..... 72/250, 245, 249, 72/251, 252, 419, 420, 426, 428

[56] References Cited

U.S. PATENT DOCUMENTS 5,630,335 5/1997 Tingvall et al. ..... 72/250

FOREIGN PATENT DOCUMENTS 61-241563 10/1986 Japan .

*Primary Examiner*—Rodney A. Butler
*Attorney, Agent, or Firm*—Kanesaka & Takeuchi

[57] ABSTRACT

A positioning control device having a moving body engaged with a screw shaft to be moved with the rotation of the screw shaft, and a rest bar for fixing the moving body having two long positioning retainers extending in the axial direction of the screw shaft makes it possible to securely hold a guide apparatus for rolling stock. The moving body is provided on its upper portion with a shift base for mounting the guide apparatus thereon, and on its lower portion with a shift bracket. A pair of hydraulic cylinders piercing through the shift bracket are opposed to each other across the screw shaft. A piston rod in each hydraulic cylinder is movable vertically so as to come into contact with the lower surface of the retaining portion of the rest bar. Both positioning retainers are secured on the retaining portion of the rest bar and disposed opposite to each other across the piston rods and the retaining portion of the rest bar so as to come into contact with the contact members of the shift base.

18 Claims, 7 Drawing Sheets

POSITIONING CONTROL DEVICE FOR GUIDE APPARATUS

BACKGROUND OF THE INVENTION

1. Field of the Invention

This invention relates to a device for controlling the position of a guide apparatus for rolling stock to be set at an entrance and other places of a rolling mill.

2. Description of the Prior Art

As described in Japanese Patent Application Disclosure No. SHO 61-241563(A) as one example, there has been so far known a positioning control device for a guide apparatus for rolling stock, which comprises a moving body for moving the guide apparatus, a feed screw shaft pierced through the lower portion of the moving body in the state engaged therewith, means for driving the feed screw shaft, and a fixing or locking means for securing the moving body.

The method of controlling the position of the guide apparatus for the rolling stock is fulfilled in the manner described below.

By operating the driving means to rotate the feed screw shaft, the moving body is moved along the roller shafts of pressure rollers in the rolling mill. The guide apparatus is controlled in position through the moving body so as to be moved to a prescribed position and secured by the fixing means at the prescribed position.

However, the conventional positioning control device involves the following problem to be solved.

Since the moving body is released from the fixing means while in movement consequently to form a gap between the contact surface thereof and the holding portion of the fixing means, there is a possibility of leaving the gap after positioning and securing the moving body and bringing the moving body out of position, as a result of which the moving body cannot be accurately positioned.

Furthermore, the moving body is prevented from moving in the axial direction of the feed screw shaft by the fixing means after being positioned, but it may possibly be displaced in the direction perpendicular to the axes of the pressure rollers, i.e. the forward and backward directions with respect to the rolling stock. As a result, accurate positioning control for the moving body cannot be fulfilled.

Also, there is a possibility of causing backlash between the male screw of the feed screw shaft and the female screw of the moving body. Accordingly, the conventional positioning control device has been required to be improved to achieve subtle accuracy in positioning the moving body.

OBJECT OF THE INVENTION

An object of the present invention is to provide a positioning control device capable of controlling the positioning of a guide apparatus in a rolling mill with a high accuracy.

SUMMARY OF THE INVENTION

To attain the object described above according to the present invention, there is provided a positioning control device comprising a screw shaft, driving means for rotating the screw shaft, a moving body movable in the axial direction of the screw shaft with the rotation of the screw shaft, a rest bar having a retaining portion at which the moving body is secured, and positioning retainers disposed on the rest bar and extending in the axial direction of the screw shaft.

The moving body is provided on its upper portion with a shift base for mounting a guide apparatus and on its lower portion with a shift bracket having a male screw engaged with the aforementioned screw shaft. The shift base has contact members. The shift bracket is provided with stopping means having an operation portion movable vertically within a gap formed between the shift bracket and the shift base. The retaining portion of the rest bar is movable in the axial direction of the screw shaft relative to the moving body within the aforementioned gap so as to bring the operation portion of the stopping means in collision with the retaining portion. The positioning retainer fixed on the retaining portion is placed opposite to the operation portion of the stopping means across the retaining portion so that it comes into collision with the contact members of the shift base.

In the positioning control device of the invention, the contact members of the shift base of the moving body are always in contact with the retaining portion of the positioning retainer during the moving body being positioned and secured. Accordingly, the shift base and the positioning retainer are prevented from wobbling and securely held without deteriorating the accuracy in positioning the moving body.

Other and further objects of this invention will become obvious upon an understanding of the illustrative embodiments about to be described or will be indicated in the appended claims, and various advantages not referred to herein will occur to one skilled in the art upon employment of the invention in practice.

DESCRIPTION OF THE PREFERRED EMBODIMENTS

Figure 1:
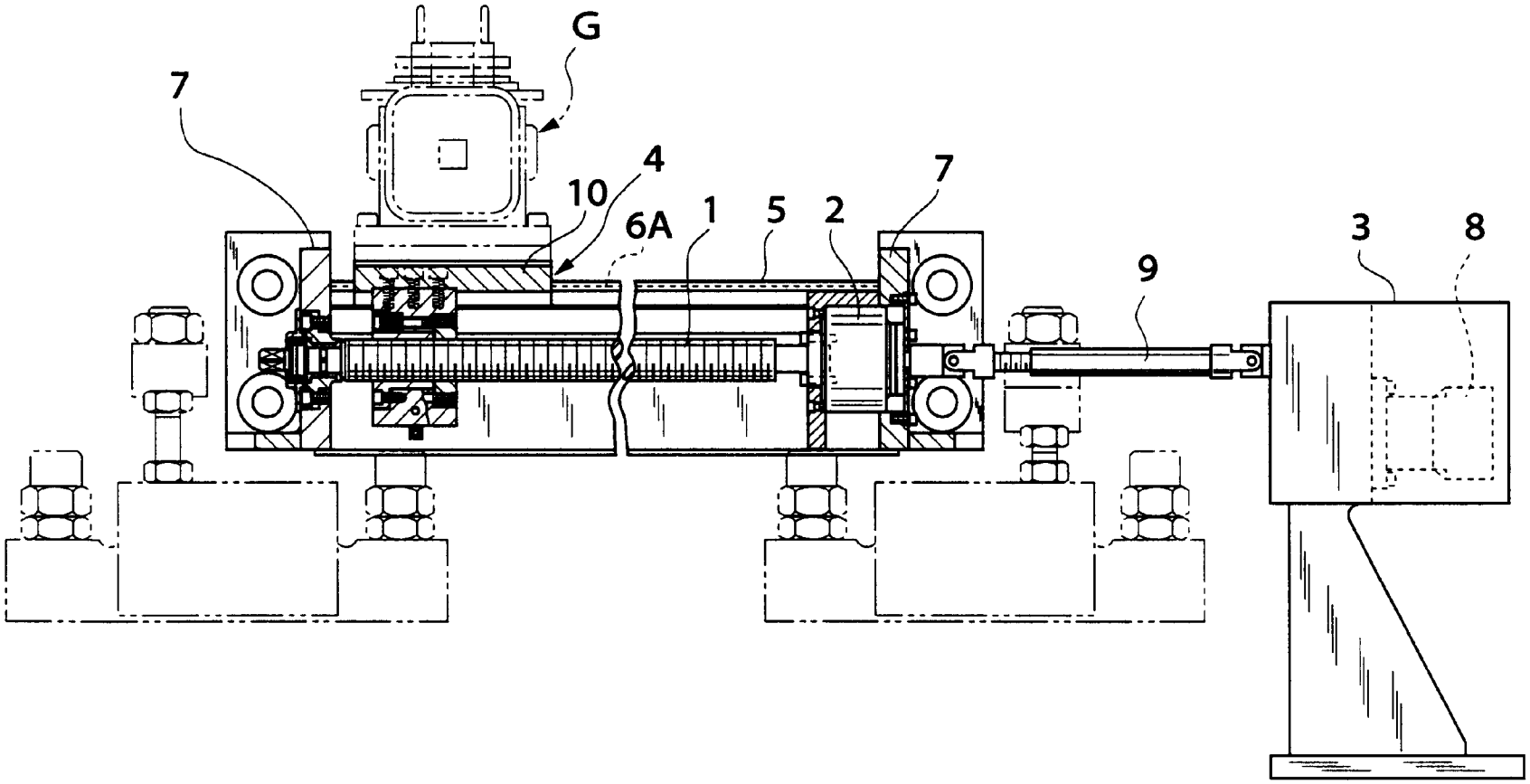
FIG. 1 is a sectional front view showing in part one embodiment of the positioning control device of the present invention.

As shown in FIG. 1 through FIG. 4, a positioning control device for a guide apparatus in one embodiment of this invention comprises a screw shaft 1, driving means 3 for imparting rotation to the screw shaft 1 through a ball reduction mechanism 2, a moving body 4 movable in the axial direction of the screw shaft with the rotation of the screw shaft 1, a rest bar 5 having a retaining portion 5*a* for retaining the moving body 4, and long positioning retainers 6A and 6B mounted on the rest bar 5 and extending in the axial direction of the screw shaft 1.

As shown in FIG. 1, the screw shaft 1 is supported rotatably at its left end by a bearing 7 and at its right end by another bearing 7 through the non-backlash ball reduction mechanism 2. The ball reduction mechanism 2 is connected with a driving unit 8 constituting the principle part of the driving means 3. The driving unit 8 incorporates a hydraulic motor in the embodiment shown in FIG. 1. The motive power produced by the hydraulic motor 8 is transmitted to the ball reduction mechanism 2 through a universal joint 9. The rotation of the ball reduction mechanism 2 is imparted to the screw shaft 1.

Figure 3:
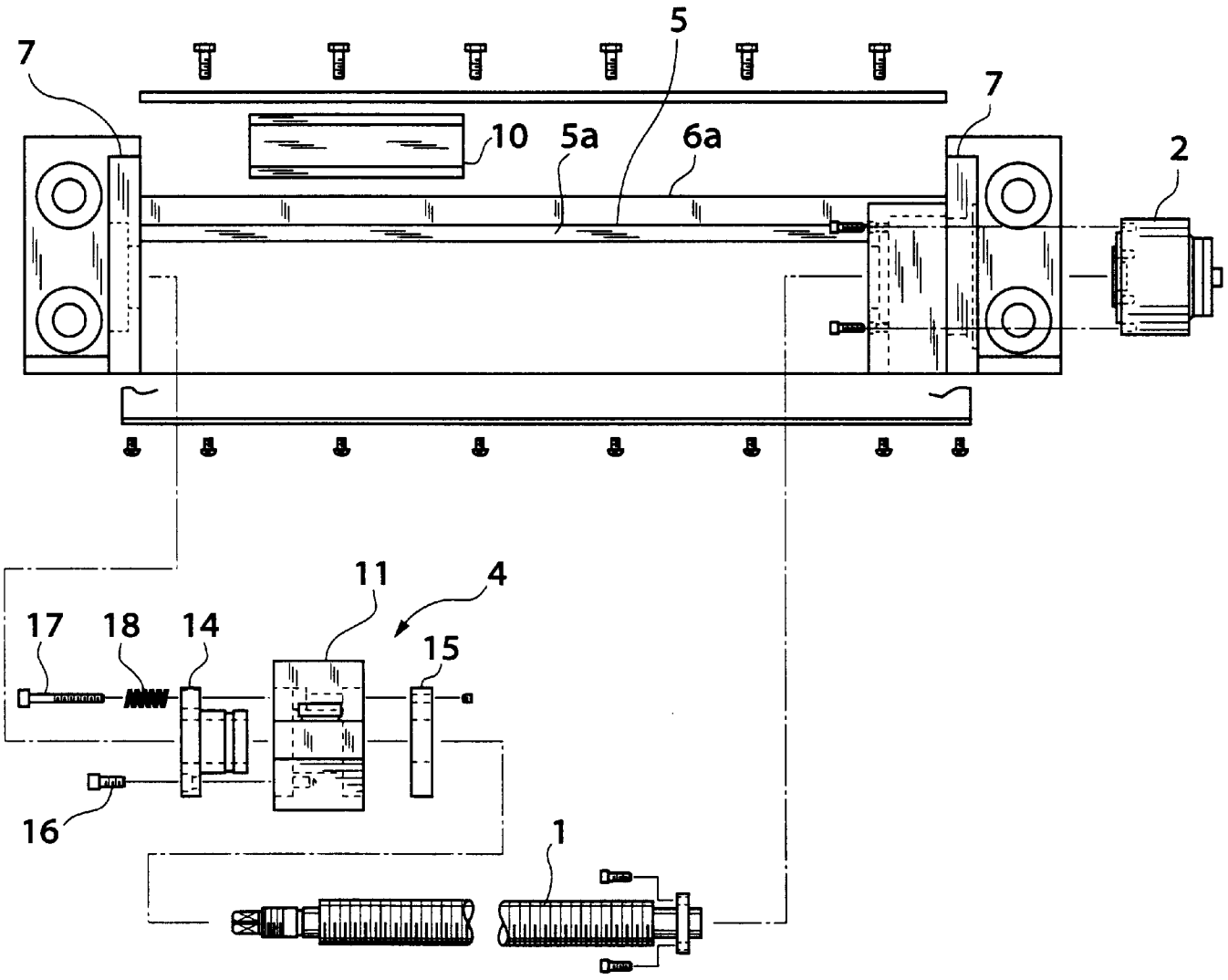
FIG. 3 is an exploded view showing, on an enlarge scale, the principle portion of the device of the invention.
Figure 4:
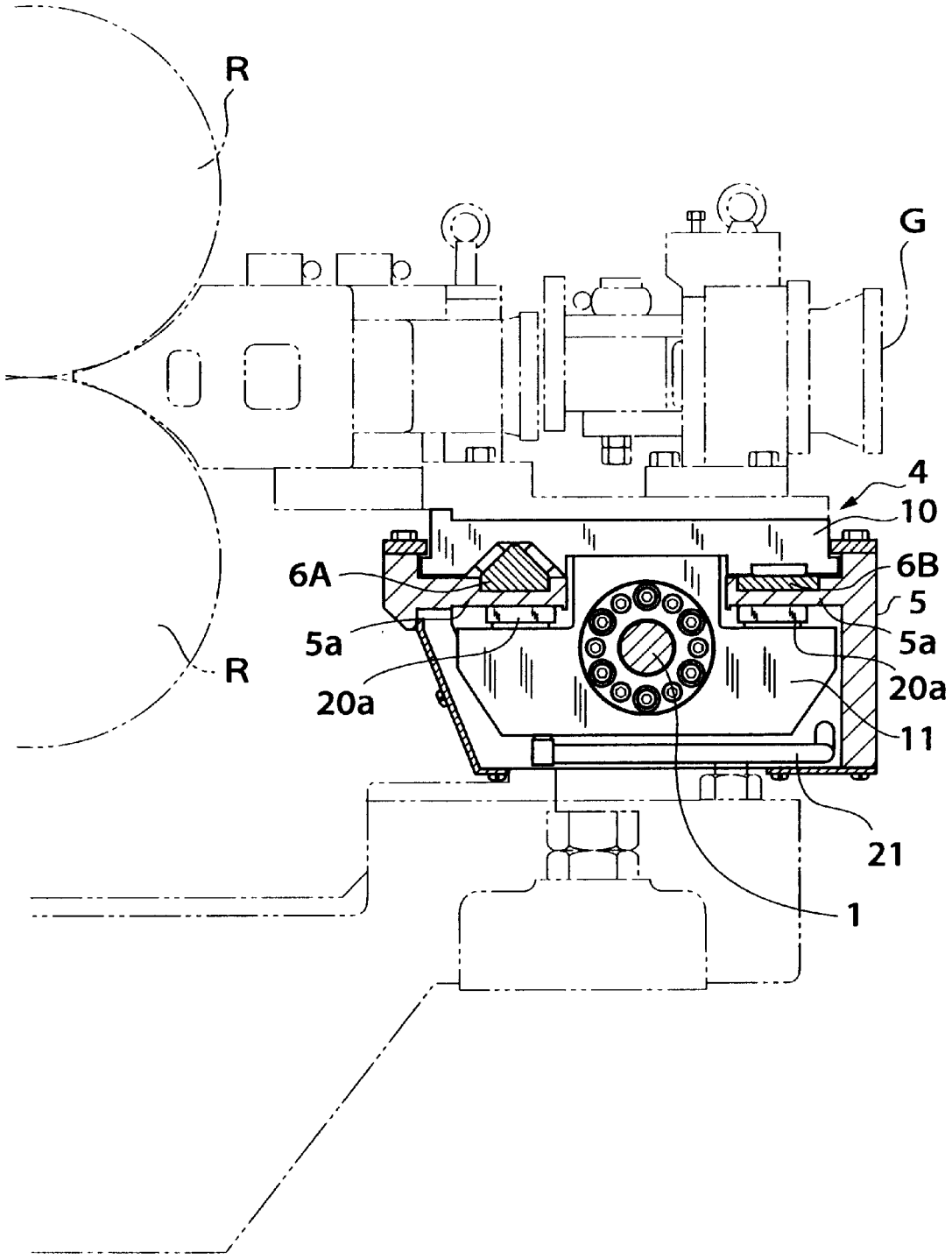
FIG. 4 is an enlarged side sectional view showing the embodiment of the device of the invention.
Figure 5:
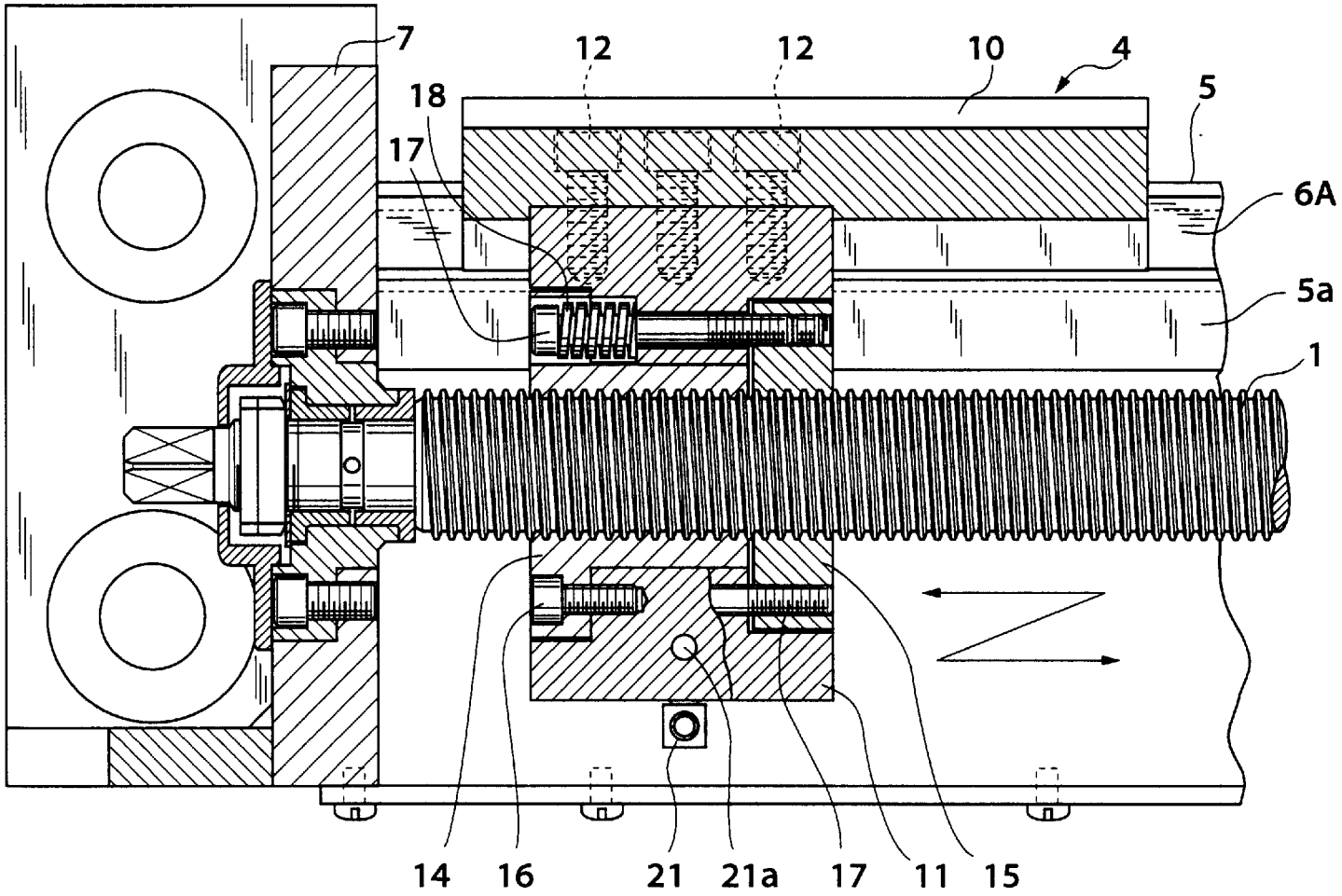
FIG. 5 is a partially sectioned view taken along line A—A in FIG. 6.
Figure 6:
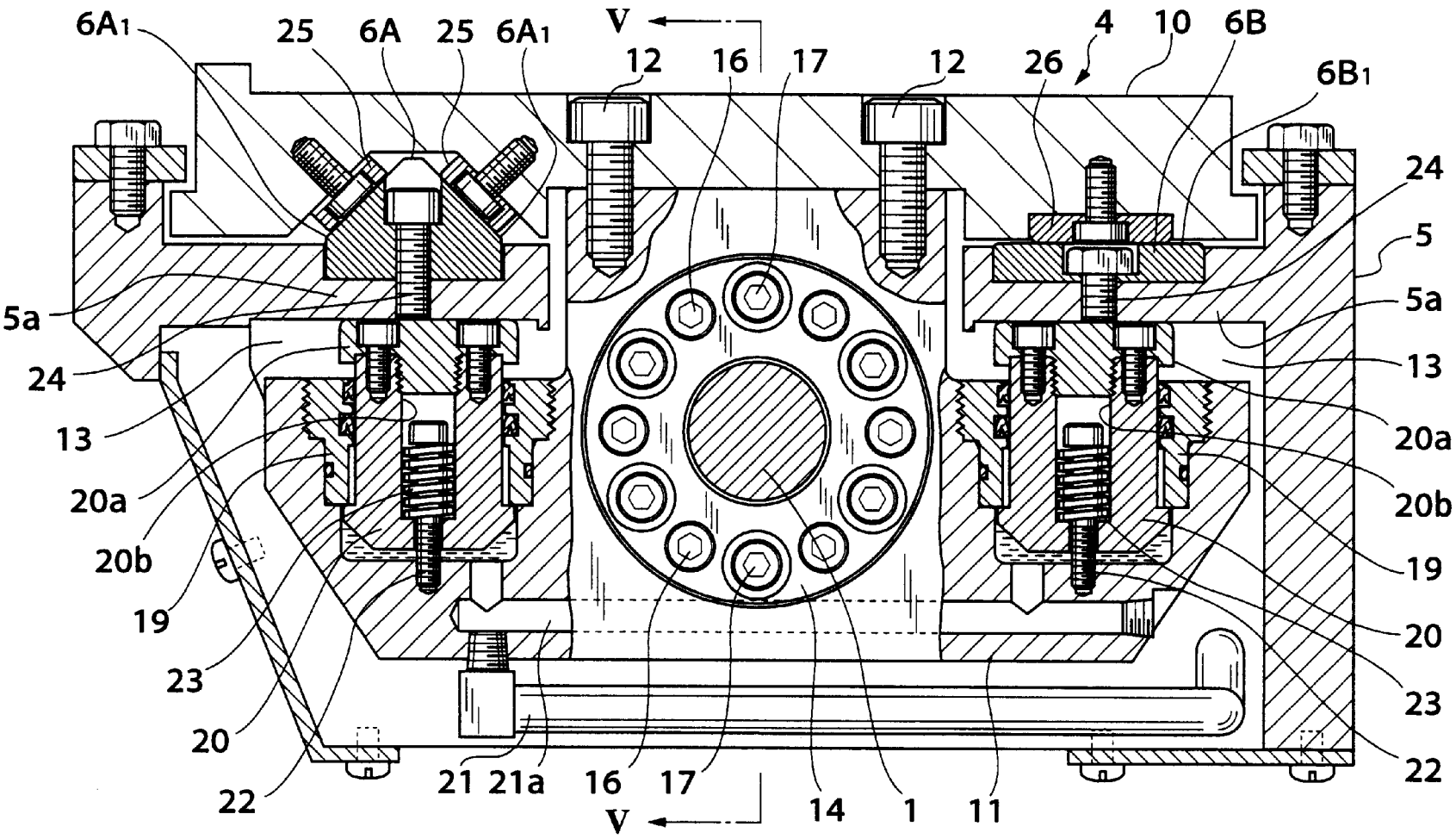
FIG. 6 is an enlarged side view showing, partially in cross section, the principle portion of the device of the invention.

As shown in FIG. 3 through FIG. 6, the moving body 4 is provided with a shift base 10 and a shift bracket 11. The guide apparatus G for guiding the rolling stock such as strip steel is detachably mounted on the shift base 10 as shown in FIG. 4. On the lower portion of the shift base 10, the shift bracket 11 is secured by use of bolts 12. As shown in FIG. 6, there is formed a gap 13 between either side portion (right and left sides in the drawing) of the lower surface of the shift base 10 and either side portion of the upper surface of the shift bracket 11. The shift base 10 is moved in the axial direction of the screw shaft 1 (right-and-left direction in FIG. 1 and FIG. 5) with the rotation of the screw shaft 1.

The screw shaft 1 is pierced through the shift bracket 11.

As shown in FIG. 3 and FIG. 5, a first screw bracket 14 and a second screw bracket 15 are fitted into an axial hole in the shift bracket 11. In the embodiment shown in FIG. 3 and FIG. 5, the first screw bracket 14 has a T-shaped cross section, and the second screw bracket 15 is shaped in a ring. In the axial parts of the first and second screw brackets 14 and 15, female screws such as trapezoidal screw threads are formed. These female screws are engaged with a male screw formed around the screw shaft 1. Thus, the shift bracket 11 can be moved in parallel with the roller shafts of pressure rollers R (FIG. 4) with the rotation of the screw shaft 1 which is imparted thereto through the screw brackets 14 and 15.

To prevent backlash between the male screw of the screw shaft 1 and the respective female screws of the first and second screw brackets 14 and 15, the shift bracket 11 has a non-backlash mechanism as shown in FIG. 5 and FIG. 6.

The non-backlash mechanism will be described in detail below.

The first screw bracket 14 is secured on the shift bracket 11 by bolts 16. Although the hex-socket bolts 16 are used in this illustrated embodiment in FIG. 5, the bolts should not be understood as being limited thereto. Bolts 17 are juxtaposed to the bolts 16. The bolts 16 and 17 are alternatively arranged coaxially on the same circle around the center of the screw shaft 1 at regular intervals in the embodiment of FIG. 6. Although the hex-socket bolts 17 are also used in this illustrated embodiment in FIG. 5, the bolts should not be understood as being limited thereto. The bolts 17 are pierced through the first screw bracket 14 in the axial direction thereof. The bolts 17 are further pierced through the shift bracket 11 and each have the leading end portion screwed in the second screw bracket 15. A compression spring 18 is set around each bolt 17 and interposed between the bolt head and the shift bracket 11. Each bolt 17 which is pierced through the first screw bracket 14 and the shift bracket 11 is screwed in the second screw bracket 11 against the energizing force of the compression spring 18. Thus, with the energizing force of the compression spring 18, the shift bracket 11 and the first screw bracket 14 fixed to the shift bracket 11 are constantly urged rightward in FIG. 5, and oppositely, the second screw bracket 15 is constantly urged leftward in FIG. 5. That is to say, the compression spring 18 serves to exert constant pressure for preventing backlash from occurring between the male screw of the screw shaft 1 and the respective female screws of the first screw bracket 14 and second screw bracket 15. The energizing force of the compressing spring 18 can be arbitrarily adjusted in accordance with the strength of the spring 18 and the length of thread engagement accomplished by the screws. With the compression springs 18, the backlash can be reliably prevented from occurring between the male screw of the screw shaft 1 and the respective female screws of the first screw bracket 14 and the second screw bracket 15.

The shift bracket 11 is secured to the retaining portion 5*a* of the rest bar 5 by a fixing mechanism. The fixing mechanism in this embodiment may be hydraulically operated as shown in FIG. 6.

The fixing mechanism shown in FIG. 6 will be explained hereinbelow.

On the right and left side portions of the shift bracket 11 in the illustrated device (i.e. side portions opposed perpendicularly to the directions in which the rolling stock is fed forward and backward), there are disposed cylinders 19 serving as stopping means. Each cylinder 19 has a single-acting piston rod 20 which works as a working element. To one end (lower end in FIG. 6) of the cylinder 19, working oil is supplied through a hydraulic oil pipe 21 and a diverging path 21*a*. By increasing hydraulic pressure given to the cylinder, the piston rod 20 is forced to move forward. The forward movement of the piston rod 20 allows the upper part 20*a* of the piston rod to come in contact with the lower surface of the retaining portion 5*a* of the rest bar 5 disposed in the gap 13. With the movement of the shift bracket 11, the retaining portion 5*a* is movable relative to the shift bracket 11 in the axial direction of the screw shaft 1 (direction vertical to the surface of FIG. 6). The piston rod 20 has a bolt-head sink hole 20*b* bored in its axial portion thereof. In the bolt-head sink hole 20*b*, a bolt 22 having a leading end portion (lower end portion in the drawing) to be screwed in the shift bracket 11 is fitted. The bolt 22 in the illustrated embodiment has a hexagon socket head. Around the outer periphery of the bolt 22, a compression spring 23 is set between the bolt head and the inner bottom portion of the bolt-head sink hole 20*b*. The compression spring 23 exerts its energizing force to the piston rod 20 so as to move the piston rod in the downward direction in FIG. 6.

Figure 2:
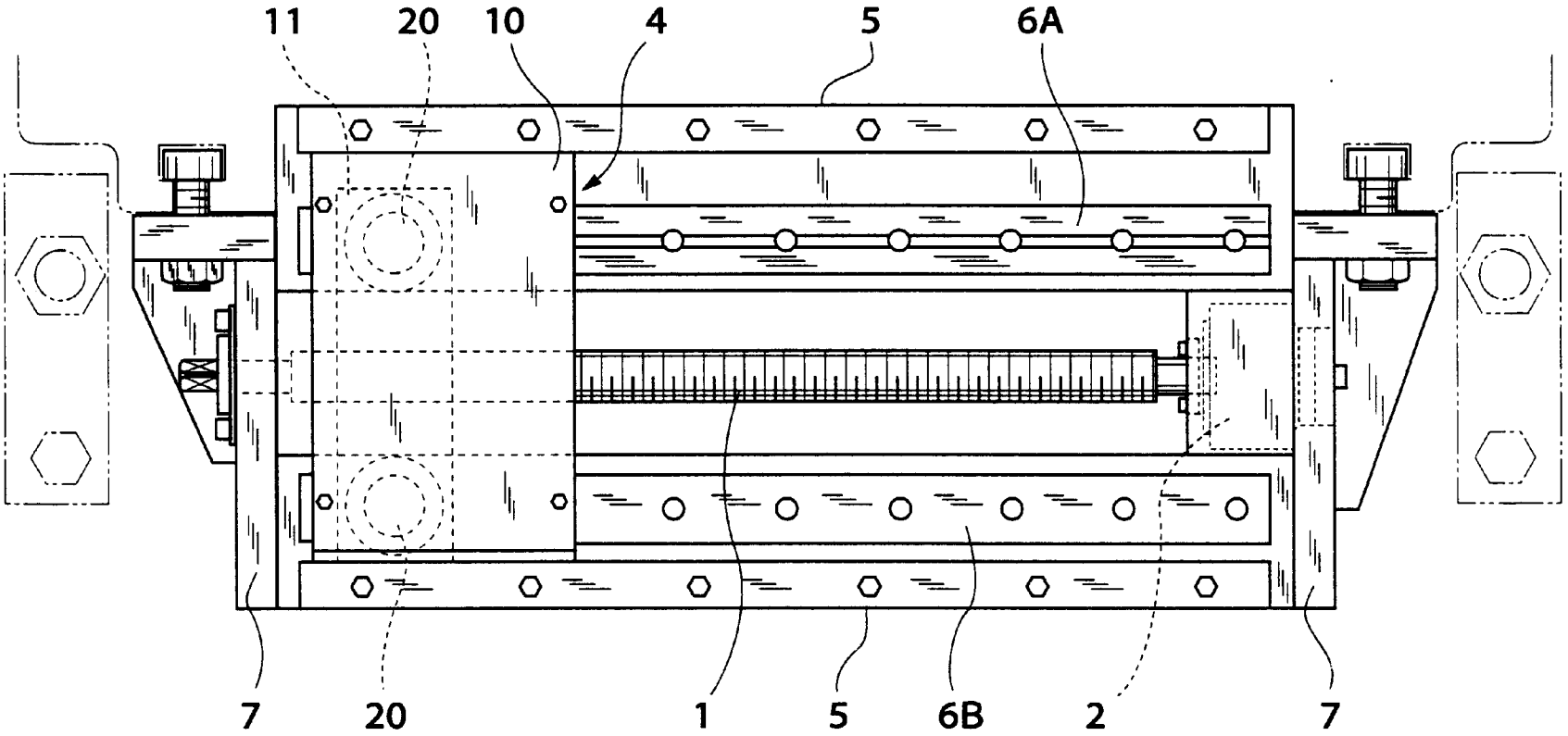
FIG. 2 is an enlarged plan view showing the device of the invention, omitting the guide apparatus and driving means in the device.
Figure 7:
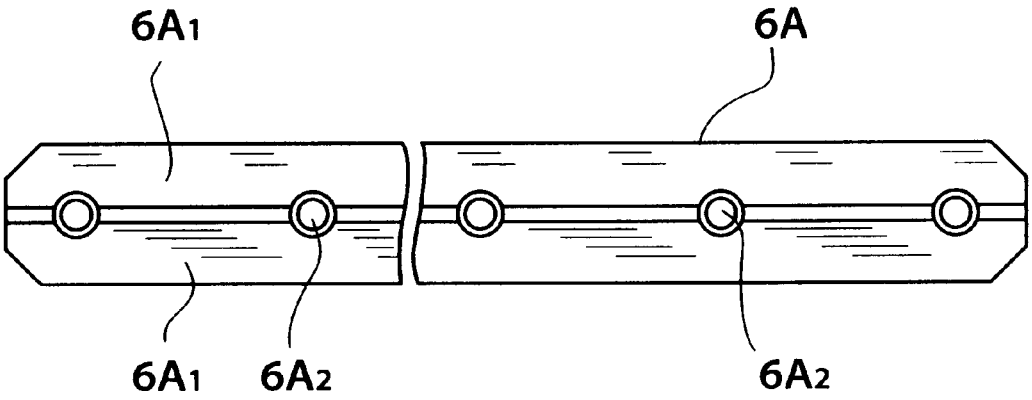
FIG. 7 is an enlarged plan view showing one of the positioning retainers in the device of the invention.
Figure 8:
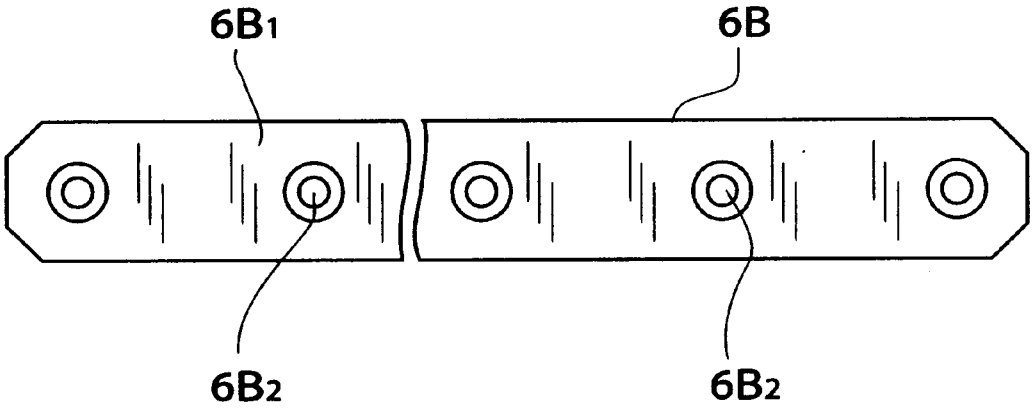
FIG. 8 is an enlarged plan view showing the other positioning retainer in the device of the invention.

On the upper end portion of each piston rod 20, opposed positioning retainers 6A and 6B are disposed across the retaining portion 5*a* of the rest bar 5. Each of the positioning retainers 6A and 6B is secured onto the retaining portion 5*a* by a bolt 24. The positioning retainer 6A shown in FIG. 7 and the positioning retainer 6B shown in FIG. 8 are made long and disposed along the screw shaft 1 as shown in FIG. 2. The positioning retainer 6A has two contact surfaces 6A1 aslant opposed to each other in a substantial V-shape in the direction perpendicular to the lengthwise direction of the positioning retainer. Each contact surface 6A1 inclines at about 45° relative to the horizontal. The contact surfaces of the shift base 10, i.e. the contact members 25 formed of a working member fixed by the bolt in the embodiment of FIG. 6, are allowed to come into contact with the contact surfaces 6A1, respectively.

The other positioning retainer 6B is made flat on its upper surface to form a contact surface 6B1, so as to allow the contact surface of the shift base 10, i.e. the contact member 26 formed of a working member fixed by the bolt in the embodiment of FIG. 6, to come into contact with the contact surface 6B1.

Next, the method for securing and releasing the moving body 4 by operating the fixing mechanism using hydraulic pressure will be described.

By securing and releasing the moving body 4, the positioning of the guide apparatus G is controlled.

The securing operation of the moving body is carried out by increasing the hydraulic pressure, i.e. in the state of securing the moving body in position at high hydraulic pressure, in the following manner.

As shown in FIG. 6, by increasing the hydraulic pressure of the working oil supplied to each cylinder 19 through the hydraulic oil pipe 21, each piston rod 20 is moved upward against the energizing force of the compression spring 23, so as to bring the upper part 20*a* of the piston rod into contact with the lower surface of the retaining portion 5*a* of the rest bar 5 to urge the retaining portion 5*a* upward. With the reaction force of the upward urging force exerted on the rest bar by the piston rods, the shift bracket 11 is urged downward to bring the contact members 25 and 26 of the shift base 10 into slidable contact with the respective contact surfaces 6A1 and 6B1 of the positioning retainers 6A and 6B. As a result, the shift base 10 and the shift bracket 11, i.e. moving body 4, are fixed in position on the retaining portion 5*a*. In this fixed state, the moving body 4 is effectively prevented from moving in the right and left directions in FIG. 6 by the positioning retainer 6A, so that the moving body 4 can be securely fixed by the action of the contact surfaces 6A1 of the positioning retainer 6A, which serve as the stopping means for the contact members 25.

The method for securing the moving body in the low-pressure fixed state, i.e. in the state of finely adjusting the position of the moving body at low hydraulic pressure, will be described hereinafter.

To carry out this securing method, the contact members 25 and 26 are brought into slidable contact with the respective contact surfaces 6A1 and 6B1 of the positioning retainers 6A and 6B by controlling the hydraulic pressure.

By performing such an operation, the shift bracket 11 (shift base 10) can be securely retained movably relative to the retaining portions 5*a* in the manner as described above. Thus, highly accurate positioning control can be accomplished without involving wobbling of the moving body.

The releasing of the moving body in a non-fixed state, i.e. when the guide apparatus is moved for maintenance or other operation under no hydraulic working pressure, is carried out in the following manner.

By reducing the hydraulic pressure of the working oil supplied to the cylinders, the piston rods 20 are urged downward by the energizing force of the compression springs 23, so as to allow the shift base 10 to move relative to the positioning retainers 6A and 6B with ease.

Next, the method of controlling and adjusting the position of the guide apparatus G will be described.

First, the screw shaft 1 is rotated at a high speed in the state of releasing the piston rods 20, to move the moving body 4 to the prescribed position along the screw shaft 1. Next, the contact members 25 and 26 of the shift base 10 are brought into slidably contact with the contact surfaces 6A1 and 6B1 of the positioning retainers 6A and 6B by controlling the hydraulic pressure in the cylinders 19, and thereupon, the screw shaft 1 is rotated at a low speed to move the moving body 4 at very low speed, so that the position of the guide apparatus G is adjusted finely. Upon positioning of the guide apparatus, the piston rods 20 are brought into high-pressure contact with the retaining portions 5*a* of the rest bar 5 to fix the moving body 4. Thus, the work of adjusting the position of the guide apparatus G is finished.

According to the positioning control device of the invention, the position of the guide apparatus G can be controlled and adjusted accurately by the three operations as described above, that is, the releasing operation in the state of moving the moving body 4 at a high speed, the low-pressure fixing operation in the state of moving the moving body 4 at very low speed, and the high-pressure fixing operation after positioning the moving body. Since the moving body is subjected to a constant load in the process of securing the moving body 4 from the low-pressure fixing operation to the high-pressure fixing operation, the moving body can be prevented from wobbling in movement.

According to the illustrated embodiment, an operator can easily accomplish various works for adjusting the position of the guide apparatus, such as of the operations of releasing and moving the moving body, finely adjusting of the position of the moving body, and securing the moving body, and can remote control the adjustment of the device by operating a control switch. Thus, the device of the invention permits the positioning adjustment operations involved in handling the guide apparatus for rolling stock in the rolling mill to be performed more simply and easily.

Although the embodiment of FIG. 1 employs the hydraulic motor 8 as driving means, the driving means is by no means limited to the hydraulic motor, and any other type of driving means operable mechanically or manually may be used instead of the hydraulic motor.

In the case of using a non-backlash type ball reduction mechanism having the reduction ratio of 1/100 in the embodiment of FIG. 1, very fine adjustment up to 0.05 mm in minimum movement can be accomplished. That is, the positioning control can be performed with extremely high accuracy of 0.05 mm.

With the structure in which the contact surfaces 6A1 of the positioning retainer 6A opposed to the shift base 10 are respectively inclined at about 45° (±45°) relative to the horizontal, the position of the moving body 4 can be adjusted in the forward and rearward directions (right and left directions in FIG. 6), so that the moving body can be slidably moved with low friction in the low-pressure fixing state. The contact surface 6A1 may be inclined generally at an angle from 20° to 60° relative to the horizontal. The other positioning retainer 6B may have the same structure as the positioning retainer 6A, or the positioning retainer 6A may be made flat similarly to the other positioning retainer 6B.

According to this embodiment, the positioning control for the guide apparatus G can be accomplished in the aforementioned three operations, i.e. the releasing operation in the state of moving the moving body 4 at a high speed by using the cylinders 19 serving as stopping means, the low-pressure fixing operation in the state of moving the moving body 4 at very low speed for adjusting the position of the moving body, and the high-pressure fixing operation after positioning the moving body. Consequently, the contact members 25 and 26 of the moving body 4 can be slidably moved along the surfaces of the positioning retainers 6*a* and 6B while maintaining the low-pressure fixed state. Thus, a load is always on the positioning retainers 6A and 6B through the contact members 25 and 26 all the time from the low-pressure fixed state to the high-pressure fixed state. Hence, even when the guide apparatus G is secured upon adjusting its position, the device of the invention does not entail a disadvantage of forming a gap or causing displacement between the contact members 25 and 26 and the positioning retainers 6A and 6B. As a result, the positioning operation for adjusting the position of the guide apparatus can be controlled with high accuracy without inflicting any injury to the rolling stock to be processed.

Furthermore, with the positioning retainer 6A having the inclined contact surfaces 6A1 which are brought into contact with the contact members 25, the moving body 4, i.e. shift base 10, is prevented from moving even if it is forcibly moved in the forward or rearward direction (right and left directions in FIG. 6). Consequently, the moving body can be adjusted in position with very high accuracy without involving wobbling when being moved to be secured.

Since the screw shaft 1 and the screw of the screw bracket 11 are constantly urged in the opposite directions to each other by the compression spring 18, backlash can be prevented from occurring therebetween, thus to increase the accuracy of adjusting the position of the moving body.

Moreover, since the positioning control device of the invention employs the hydraulic motor 8 as the driving means and the fixing mechanism having the cylinders serving as the stopping means, the adjustment of the guide apparatus can be remote controlled and therefore conducted in safety. Besides, the work of adjusting the position of the guide apparatus, which have conventionally had to carry out for several tens of minutes by a few operators, can be rapidly done by remote operating a single control switch by only one operator, consequently to markedly lessen the operator's labor involved in adjusting the position of the guide apparatus.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. A positioning control device for a guide apparatus, comprising a screw shaft, driving means for rotating said screw shaft, a moving body movable in the axial direction of said screw shaft with rotation of said screw shaft, a rest bar having a retaining portion at which said moving body is secured, and positioning retainers disposed on said rest bar and extending in said axial direction of said screw shaft, said moving body being provided on its upper portion with a shift base for mounting said guide apparatus and on its lower portion with a shift bracket having a male screw engaged with said screw shaft, said shift base being provided with contact members, and said shift bracket being provided with stopping means having an operation portion movable vertically within a gap formed between said shift bracket and said shift base, said retaining portion of said rest bar being movable in the axial direction of said screw shaft relative to said moving body within said gap so as to bring said operation portion of said stopping means in contact with said retaining portion, and said positioning retainers secured on said retaining portion being placed opposite to said operation portion of said stopping means across said retaining portion so as to come into contact with said contact members of said shift base.

2. A positioning control device according to claim 1, wherein one of said positioning retainers have contact surfaces aslant opposed to each other in a substantial V-shape in a direction perpendicular to a lengthwise direction of said positioning retainer, so as to allow said contact surfaces of said positioning retainer to come into contact with the contact members of said shift base.

3. A positioning control device according to claim 1, wherein said shift bracket has an axial hole into which adjoining first and second screw brackets are fitted, said first and second screw brackets having axial holes with female screws to be engaged with male screws on said screw shaft, either one of said first and second screw brackets being connected to said shift bracket, said female screws of said first and second screw brackets and said male screws of said screw shaft being urged in the opposite directions by compression springs to prevent backlash from occurring therebetween.

4. A positioning control device according to claim 2, wherein said shift bracket has an axial hole into which adjoining first and second screw brackets are fitted, said first and second screw brackets having axial holes with female screws to be engaged with male screws on said screw shaft, either one of said first and second screw brackets being connected to said shift bracket, said female screws of said first and second screw brackets and said male screws of said screw shaft being urged in the opposite directions by compression springs to prevent backlash from occurring therebetween.

5. A positioning control device according to claim 1, wherein said screw shaft is connected to a ball reduction mechanism having a reduction ratio of 1/100, so that said screw shaft is rotated by said driving means through said ball reduction mechanism.

6. A positioning control device according to claim 2, wherein said screw shaft is connected to a ball reduction mechanism having a reduction ratio of 1/100, so that said screw shaft is rotated by said driving means through said ball reduction mechanism.

7. A positioning control device according to claim 3, wherein said screw shaft is connected to a ball reduction mechanism having a reduction ratio of 1/100, so that said screw shaft is rotated by said driving means through said ball reduction mechanism.

8. A positioning control device according to claim 4, wherein said screw shaft is connected to a ball reduction mechanism having a reduction ratio of 1/100, so that said screw shaft is rotated by said driving means through said ball reduction mechanism.

9. A positioning control device according to claim 1, wherein said stopping means is formed of at least one cylinder operated by hydraulic oil, said cylinder incorporating a working piston rod which is allowed to come into contact with said rest bar.

10. A positioning control device according to claim 2, wherein said stopping means is formed of at least one cylinder operated by hydraulic oil, said cylinder incorporating a working piston rod which is allowed to come into contact with said rest bar.

11. A positioning control device according to claim 3, wherein said stopping means is formed of at least one cylinder operated by hydraulic oil, said cylinder incorporating a working piston rod which is allowed to come into contact with said rest bar.

12. A positioning control device according to claim 4, wherein said stopping means is formed of at least one cylinder operated by hydraulic oil, said cylinder incorporating a working piston rod which is allowed to come into contact with said rest bar.

13. A positioning control device according to claim 5, wherein said stopping means is formed of at least one cylinder operated by hydraulic oil, said cylinder incorporating a working piston rod which is allowed to come into contact with said rest bar.

14. A positioning control device according to claim 6, wherein said stopping means is formed of at least one cylinder operated by hydraulic oil, said cylinder incorporating a working piston rod which is allowed to come into contact with said rest bar.

15. A positioning control device according to claim 7, wherein said stopping means is formed of at least one cylinder operated by hydraulic oil, said cylinder incorporating a working piston rod which is allowed to come into contact with said rest bar.

16. A positioning control device according to claim 8, wherein said stopping means is formed of at least one cylinder operated by hydraulic oil, said cylinder incorporating a working piston rod which is allowed to come into contact with said rest bar.

17. A positioning control device for a guide apparatus, comprising a screw shaft, hydraulic motor for giving rotation to said screw shaft, a moving body movable in the axial direction of said screw shaft with rotation of said screw shaft, a rest bar having a retaining portion at which said moving body is secured, and two long positioning retainers disposed on said rest bar and extending in said axial direction of said screw shaft, said moving body being provided on its upper portion with a shift base for mounting said guide apparatus and on its lower portion with a shift bracket having a male screw engaged with said screw shaft, said shift base being provided with contact members, said shift bracket being provided with hydraulic cylinders mounted across said screw shaft, each hydraulic cylinder incorporating a piston rod movable vertically between said shift bracket and said shift base, said positioning retainers being secured on said retaining portion of said rest bar and disposed opposite to each other across said piston rod of each said hydraulic cylinder and said retaining portion, said positioning retainers being movable so as to bring said operation portion of said stopping means in contact with said retaining portion, at least one of said positioning retainers being provided with contact surfaces aslant opposed to each other in a substantial V-shape so as to allow said contact surfaces to come into contact with the contact members of said shift base.

18. A positioning control device according to claim 17, wherein said screw shaft is provided on its hydraulic motor side with an end connected to a ball reduction mechanism having a reduction ratio of 1/100, so that said screw shaft is rotated by said hydraulic motor through said ball reduction mechanism.

* * * * *